US005791641A

United States Patent [19]

Müller

[11] Patent Number: 5,791,641

[45] Date of Patent: Aug. 11, 1998

[54] APPARATUS FOR PROCESSING PRINTED PRODUCTS

[75] Inventor: Erwin Müller, Dürnten, Switzerland

[73] Assignee: Ferag AG, Hinwil, Switzerland

[21] Appl. No.: 672,416

[22] Filed: Jun. 28, 1996

[30] Foreign Application Priority Data

Jun. 30, 1995 [CH] Switzerland ..... 01 919/95-5

[51] Int. Cl.[6] ..... B65H 39/00

[52] U.S. Cl. ..... 270/52.16; 270/52.3; 270/58.29; 271/82

[58] Field of Search ..... 270/52.16, 52.3, 270/58.01, 58.29; 271/69, 204, 82, 9.12, 9.07

[56] References Cited

U.S. PATENT DOCUMENTS

| | | | |
|---|---|---|---|
| 3,951,399 | 4/1976 | Reist . | |
| 4,058,202 | 11/1977 | Reist et al. | 271/82 X |
| 4,684,116 | 8/1987 | Hänsch . | |
| 4,684,117 | 8/1987 | Honegger et al. . | |
| 4,735,406 | 4/1988 | Weber . | |
| 4,813,662 | 3/1989 | Merwarth et al. | 271/82 X |
| 5,052,666 | 10/1991 | Hänsch . | |
| 5,052,667 | 10/1991 | Hänsch . | |
| 5,094,438 | 3/1992 | Reist et al. . | |
| 5,110,108 | 5/1992 | Muller | 271/82 X |
| 5,165,672 | 11/1992 | Backman . | |
| 5,269,504 | 12/1993 | Backman . | |
| 5,292,110 | 3/1994 | Honegger . | |
| 5,324,014 | 6/1994 | Honegger et al. . | |
| 5,350,167 | 9/1994 | Hansch | 271/82 |
| 5,653,432 | 8/1997 | Hansch | 271/82 |

FOREIGN PATENT DOCUMENTS

| | | |
|---|---|---|
| A-0354343 | 2/1990 | European Pat. Off. . |
| A-0510525 | 10/1992 | European Pat. Off. . |
| A-2247408 | 5/1975 | France . |
| A-3620945 | 1/1987 | Germany . |
| WO-A-9104934 | 4/1991 | WIPO . |

*Primary Examiner*—Hoang Nguyen
*Attorney, Agent, or Firm*—Brinks Hofer Gilson & Lione

[57] ABSTRACT

An apparatus has pocket-like receiving parts into which printed products are introduced by feeders. Each receiving part is assigned clamps that can be moved to transport the printed products in the longitudinal direction of the receiving part. The movement path of the clamps runs along the opening of the receiving part, and the clamps retain the printed products at their border region remote from the base of the receiving part.

8 Claims, 3 Drawing Sheets

APPARATUS FOR PROCESSING PRINTED PRODUCTS

BACKGROUND OF THE INVENTION

The present invention relates to an apparatus for processing printed products. In particular, the present invention relates to an apparatus having pocket-like receiving parts for processing printed products.

An apparatus of this type is disclosed in U.S. Pat. No. 5,094,438 and the corresponding EP-A-0453343. This apparatus has a plurality of receiving parts that are arranged in a drum-like manner around a common horizontal rotary axis and have a radially inner base and outer opening. Each receiving part is assigned a carriage that can be moved in the direction of the rotary axis, and is mounted on a wall that bounds the receiving part. The wall runs parallel to the rotary axis and forms the base of the receiving part. Arranged on the carriage at a distance (one behind the other, in the direction of the rotary axis) are clamps which interact with a wall element of the carriage. These clamps can be changed over together, by a control device, from a closed position, into an open position, and back again. The carriages are also connected to a drive in order to be moved, during a rotation of the receiving parts around the rotary axis, by one working stroke in the longitudinal direction of the receiving parts and by one return stroke in the opposite direction.

The apparatus also has feeders that are arranged one behind the other (in the direction of the rotary axis) and are used to introduce one printed product into each receiving part. The printed products come to rest on the base by way of their leading edge, relative to the introduction direction. The printed products are then retained by the clamps being closed and, during a rotation of the receiving part around the rotary axis, are transported by a working stroke to the next feeder. At the next feeder, in the manner of collation, a further printed product is added and is arranged congruently with the printed products that are already present.

In this known apparatus, the design of the receiving parts with the walls and the carriages, guided thereon, and with the clamps, involves a high degree of outlay which takes up a considerable amount of space.

Accordingly, an object of the present invention is to develop an apparatus of the generic type such that the construction of the receiving parts is simplified and the space requirement thereof is smaller.

SUMMARY OF THE INVENTION

The present invention provides an apparatus for processing printed products comprising a plurality of pocket-like receiving parts driven in a rotary path, at least one feeder for introducing printed products into the receiving parts, and a plurality of controlled clamps assigned to each receiving part for transporting the printed products in the receiving parts. The receiving parts are arranged one behind the other and transversely with respect to the rotary path. In addition, the receiving parts also have a base and an opening opposite the base.

The clamps are capable of moving in the rotary path with the receiving parts and also have a movement path with at least a section of the movement path running along the opening of the respective receiving parts. The clamps further include a mouth that is directed toward the interior of the receiving part when the clamps are in this section of the movement path. The mouth retains and transports printed products that are arranged in the receiving part at a border region of the printed products remote from the base.

In the apparatus of the present invention, the clamps do not need any space in the receiving parts themselves. Furthermore, the walls of the receiving parts, the base thereof, and the control device for the clamps may be of extremely simple design. In addition, the invention permits different designs of the movement path of the clamps, and therefore ones that are adapted to particular requirements.

DETAILED DESCRIPTION OF THE PRESENTLY PREFERRED EMBODIMENTS

Figure 1:
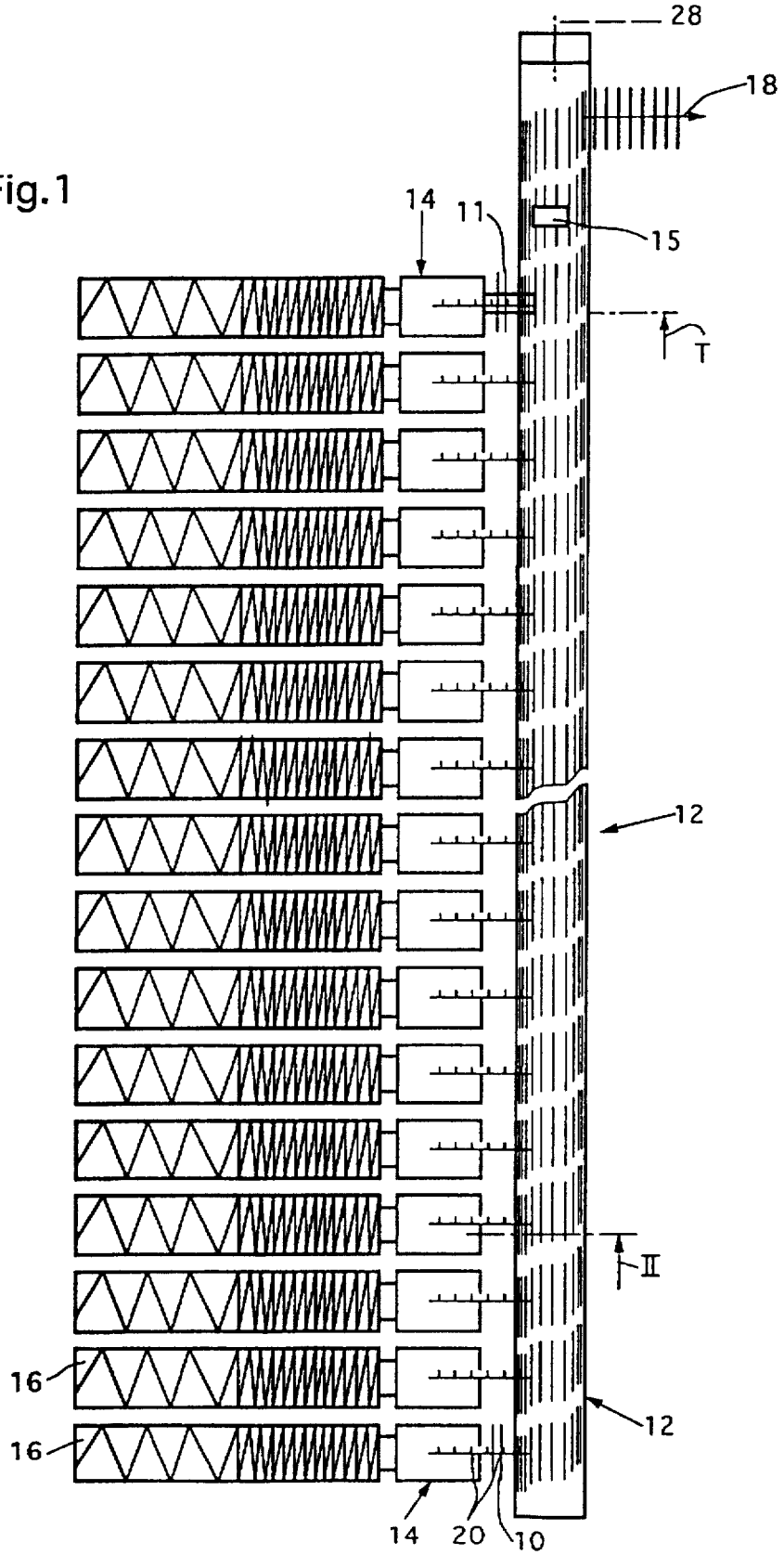
FIG. 1 shows a plan view of an apparatus for collating printed products, the apparatus having receiving parts that are arranged in the manner of a drum around a horizontal rotary axis and a plurality of feeders for the printed products.

FIG. 1 shows an apparatus for processing printed products 10, a collating drum 12, and feeders 14 that are arranged at a distance, one behind the other, in the longitudinal direction of the drum. The feeders are used for feeding, to the drum 12, printed products 10 which are supplied by a storage unit 16. The printed products are transported in the arrow direction T and collated at the drum. As seen in the arrow direction T, the feeders 14 have arranged downstream of them a remover 18, which is used to convey the collated printed products 10 away from the drum 12.

Figure 2:
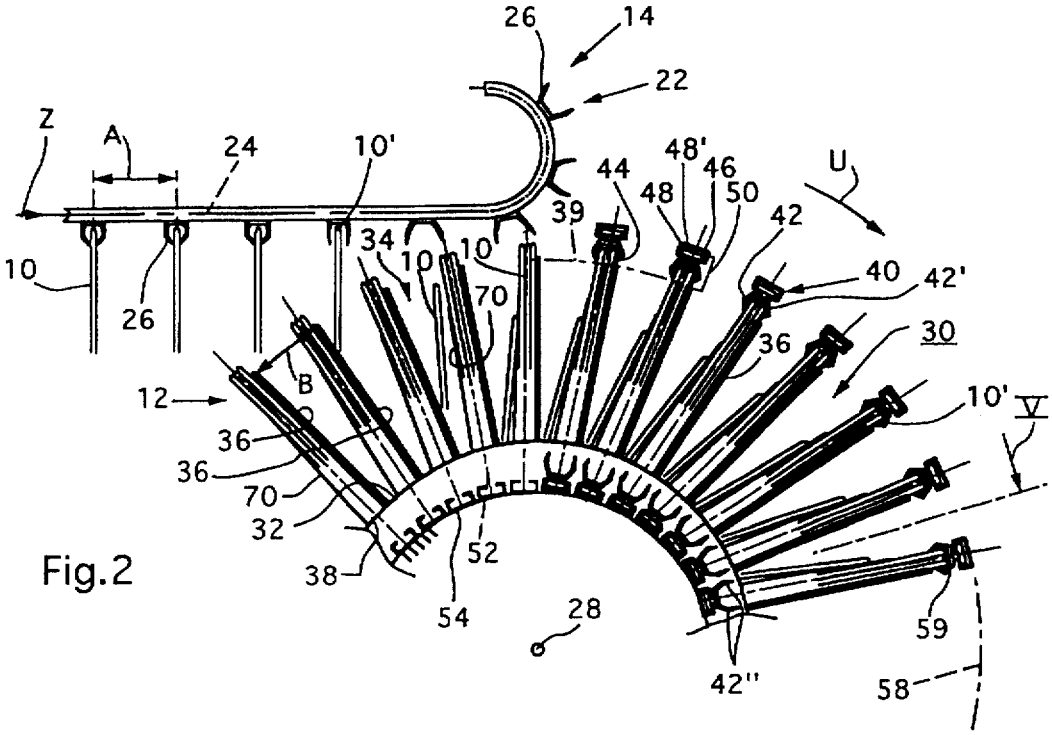
FIG. 2 shows a cross-sectional view of the apparatus for collating printed products of FIG. 1, taken along line II of FIG. 1.

As can be seen in FIG. 2, each feeder 14 has a clamp-type conveyor 22 with individually controllable conveying clamps 26. The conveying clamps 26 are arranged at a distance A, one behind the other, on an endless drawing element 24, for example a chain, that is driven in circulation in the feed direction Z. The conveying clamps 26 are used for feeding printed products 10 individually, in a hanging position, to the drum 12, and for transferring the printed products 10 to the drum by the clamp being opened.

The collating drum 12 has receiving parts 30 which are arranged around a common horizontal rotary axis 28 and have a radially inner base 32 and a radially outer opening 34. Receiving parts 30, which follow one after the other in the circumferential direction of the drum 12, are separated from one another by planar walls 36 that run parallel to the rotary axis 28. The planar walls 36, at least approximately in the radial direction, are fastened radially to the outside of a hollow shaft 38 that is coaxial with the rotary axis 28. The hollow shaft is driven in a rotational direction U. The receiving parts 30 thus rotate along a continuous, circular rotary path 39 and are arranged at right angles with respect to the latter. As measured in the circumferential direction and at their radially outer end, the distance B between successive walls 36 corresponds approximately to the distance A between the conveying clamps 26. As a result, when the clamp-type conveyor 22 is driven in time with the drum 12, a printed product 10 is fed to each receiving part 30.

Each receiving part 30 is assigned a transporting device 40 which is used to transport those printed products 10 that have been fed to the relevant receiving part 30 by the feeder 14. During each rotation of the drum 12, these printed products 10 are transported in the transporting direction T from one feeder 14 to the next, and ultimately, during one or two further rotations of the drum, to the remover 18. The transporting device 40 has clamps 42 that are arranged at a distance C, one behind the other, and whose movement path 44 runs along the opening 34 of the relevant receiving part 30 and in the direction of the rotary axis 28. The clamps 42 have a mouth 42' directed toward the interior of the receiving part 30. The distance C between the clamps 42, as measured in the direction of the rotary axis 28, corresponds to the distance between adjacent clamp-type conveyors 22. As seen in the circumferential direction of the drum 12, the movement path 44 runs adjacent to the front wall 36 of the relevant receiving part 30, with respect to the rotational direction U. As a result, the clamps 42 can grip and retain printed products 10 that are arranged in the receiving part 30 and rest on the wall 36.

Figure 3:
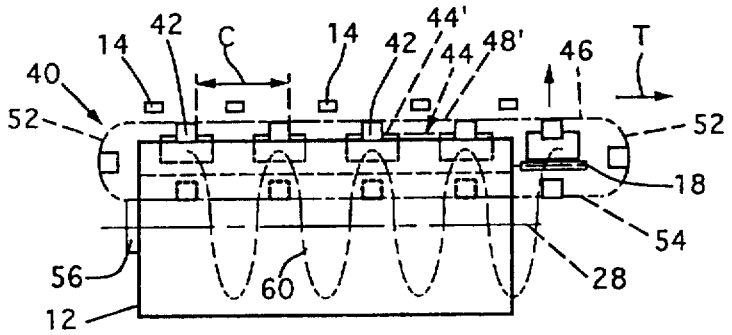
FIG. 3 shows the apparatus for collating printed products of FIGS. 1 and 2 in an elevation view that is shortened in the direction of the rotary axis.

In the transporting device 40 shown in FIGS. 2 and 3, the clamps 42 are arranged on an endless drawing member 46, for example a chain, that is guided in a cross-sectionally C-shaped duct 48. A section 48' of the duct 48 is fastened on the wall 36 via carrying brackets 50, and runs parallel to the radially outer wall end. As a result, in the active section 44' of their movement path 44, the clamps 42 can move between the duct 48 and the wall 36 without coming into contact with the same. In the section 48', the active strand of the drawing member 46 thus runs parallel to the opening 34. The section 48' is adjoined at both ends by a side section 52 that extends inward in the radial direction. The two side sections 52 are connected to one another by a connecting section 54 running in the hollow shaft 38. A drive 56 is used to drive the drawing member 46 in the transporting direction T synchronously with the rotation of the drum 12.

The tongues 42" which form the mouth 42' of the clamps 42 are prestressed in the closure direction and can be temporarily transferred into the open position by an opening element 58, for example a guide (indicated by chain-dotted lines). Each feeder 14 and remover 18 is assigned an opening element 58. Furthermore, in the base of the mouth 42', each clamp 42 has a stop 59 for the printed products 10.

The dashed line designated by 60 in FIG. 3 indicates the helical path, in the drum 12 up to the remover 18, of a printed product 10 that is introduced into a receiving part 30 by the first feeder 14, with respect to the transporting direction T.

Figure 6:
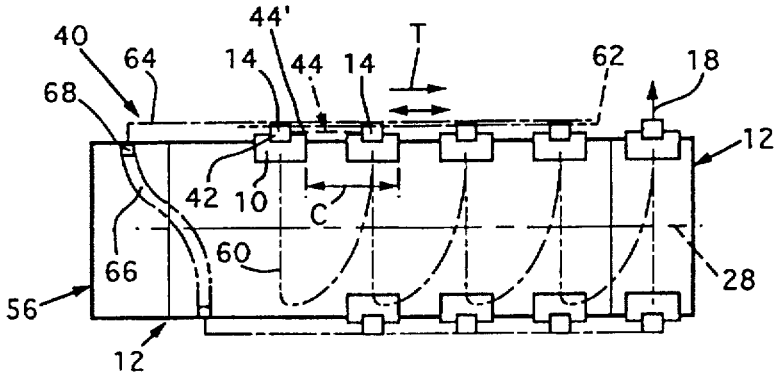
FIG. 6 shows a further embodiment of an apparatus according to the present invention, with clamps that are driven back and forth.

In the embodiment of the apparatus shown in FIG. 6, the feeder 14, the remover 18, and the receiving parts 30 of the collating drum 12 are designed as shown in FIG. 2 and described above. There are, however, differences in the embodiment shown in FIG. 6 with respect to the transporting device 40. Once again, the transporting device has clamps 42 that are assigned to each receiving part 30 and are guided on a guide member 62 corresponding to the section 48' of the duct 48. The guide member is likewise fastened on the relevant wall 36, at a distance therefrom, by carrying brackets. The clamps 42, which are arranged at a distance C, one behind the other, are connected to one another and to the drive 56 by a linkage 64. The drive includes a stroke guide 66 that has an enclosed design, of a known manner, and on which there is guided a follow-on member 68 that is arranged on the linkage 64. As a result of the stationary stroke guide 66, the clamps 42, during a rotation of the relevant receiving part 30 around the rotary axis 28, are moved forwards by a working stroke in the transporting direction T, and back by a return stroke in the opposite direction. During the working stroke, the clamps 42 are closed, for retaining the printed products 10, whereas they are opened during the return stroke. Consequently, the printed products 10 are transported in steps, in the receiving parts 30, in the direction of the rotary axis from one feeder 14 to the next, and ultimately to the remover 18. The path of the printed products 10 is indicated by chain-dotted lines and designated by 60.

Figure 4:
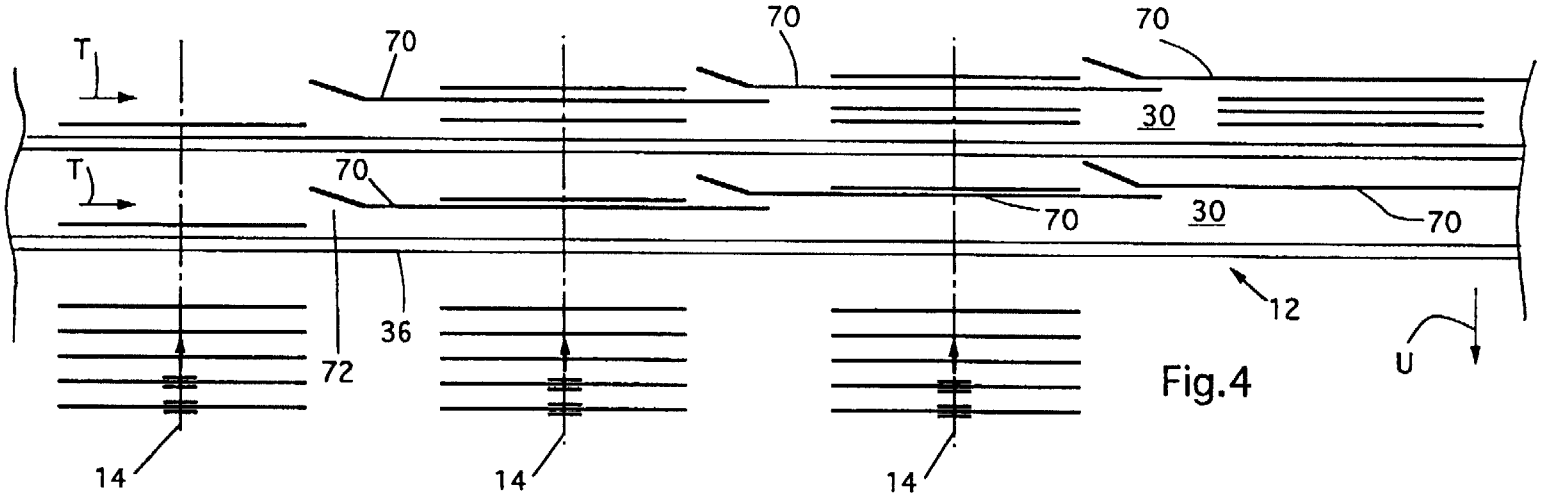
FIG. 4 shows parts of the apparatus for collating printed products of FIGS. 1–3, in order to illustrate the processing steps.
Figure 5:
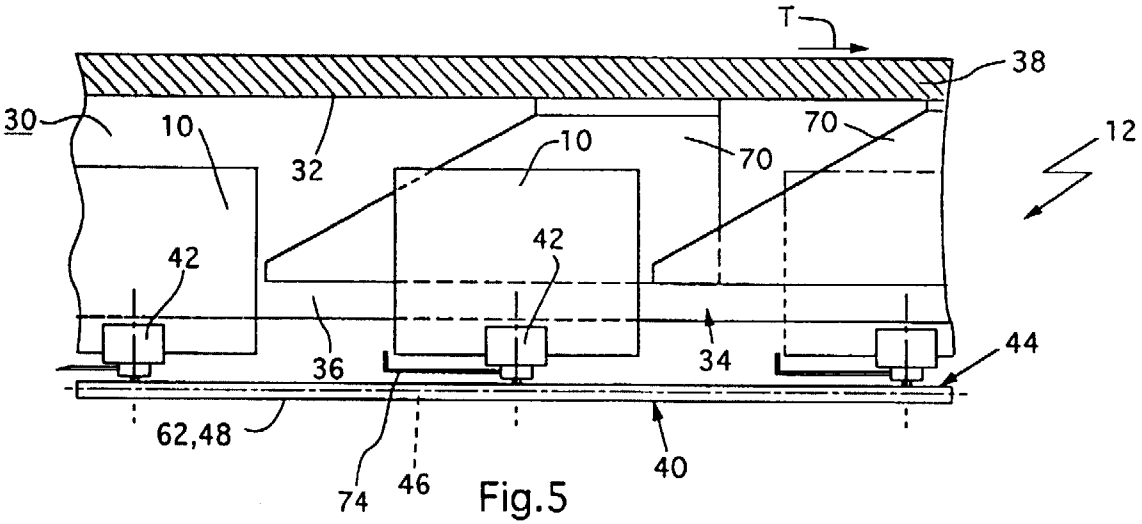
FIG. 5 shows a cross-sectional view of the apparatus for collating printed products of FIG. 1, taken along line V of FIG. 2.

As can be seen in FIGS. 2, 4 and 5, guide plates 70 are arranged in each receiving part 30, to be precisely level with the second and each following feeder 14, with respect to the transporting direction T. The essentially trapezoidal guide plates 70 are fastened on the base 32 of the receiving part 30, i.e. on the hollow shaft 38, and their tapering part is directed counter to the transporting direction T. The free end region of this part is bent in order to form, along with the front wall 36 of the receiving part 30, with respect to the rotational direction U, an inlet 72 that tapers in the form of a wedge. Furthermore, the guide plates 70 are advantageously retained, with a small degree of pre-stressing, in the direction of the wall 36.

Furthermore, FIG. 5 shows clamps 42 which are assigned to the relevant receiving part 30 and are moved along the duct 48 or guide member 62 by the drive 56. For the sake of completeness, it should be mentioned that, in the embodiment shown in FIGS. 2 and 3 with a rotating drawing member 46, each clamp 42 is assigned a carry-along member 74 so that the printed products 10 are carried along in the transporting direction T when the clamp 42 is open.

The first feeder 14 with respect to the transporting direction T (the lowermost feeder in FIG. 1), introduces a printed product 10 into each receiving part 30 of the drum 12 rotating in the rotational direction U. The printed product is allowed to drop by the conveying clamp 26 being opened, with the result that its lower border comes to rest on the base 32 (see FIGS. 2 and 4 at the feeder shown on the far left-hand side). After passing beyond a vertical plane through the rotary axis 28, the printed product 10 comes to rest flatly on the front wall 36 of the receiving part 30, with respect to the rotational direction U. After further passing beneath a horizontal plane through the rotary axis 28, the printed product 10 slides on the wall 36, away from the base 32, and into the clamp 42 which is held open by the opening element 58. When the clamp 42 is closed, it grips the printed product 10 at its border region 10', which then projects out of the opening 34 beyond the receiving part 30. The clamp 42 then transports the printed product 10, during the following rotation, in the transporting direction T to a point level with the next feeder. The printed product is then directed through the inlet 72 and comes to lie between the wall 36 and the guide plate 70 (see FIG. 4, central feeder 14, upper receiving part 30).

In the same manner as the first feeder 14, the second feeder 14, with respect to the transporting direction T, feeds a printed product 10 to each receiving part 30. The printed product is introduced between the guide plate 70 and the receiving-part rear wall 36, with respect to the rotational direction U, downstream of the guide plate 70 (see FIGS. 2 and 4, central feeder 14). After passing beneath a horizontal through the rotary axis 28, the printed product 10 then slides, on the guide plate 70, away from the base 32 in the radial direction. With its border region 10' in front, the printed product then slides into the clamp 42 which is open again. After being closed, the clamp then secures the two collated printed products 10 and carries them along in the transporting direction T. Since the printed product that is fed by the second feeder 14 comes to rest on the guide plate 70, it is not carried along by the printed product 10 that is arranged on the other side of the guide plate 70 and is moved in the transporting direction T. Instead, its position remains unchanged, with respect to the axial direction, until it runs into the open mouth 42' of the relevant clamp 42. While the clamp 42 is open, the printed products 10 that are arranged in the mouth 42' by their border region 10' are carried along by the carry-along member 74. For the sake of completeness, it should be mentioned that the position of the feeder 14 in the direction of the rotary axis 28 is selected so that the printed products 10 are discharged in the correct position. After the clamp 42 is closed, the two collated printed products 10 are transported to the next feeder 14 in the receiving part 30 during the next rotation. A further printed product 10 is added in the same manner at the next feeder 14. As can be seen, in particular, from the upper of the two compartments shown in FIG. 4, the two printed products 10 pass, during this transportation, between the corresponding guide plate 70 and the front wall 36. The printed product that is fed by the third feeder 14 is then introduced into the receiving part 30 on the other side of the guide plate 70.

In this manner, the desired number of printed products 10 are collated and then pass ultimately, by virtue of transportation in the receiving parts 30, to the remover 18, where they are conveyed away from the collating drum 12.

In the case of the embodiment shown in FIG. 6, the printed product 10 that is fed to a receiving part 30 by the first feeder, with respect to the transporting direction T, slides on the front wall 36 of the receiving part 30, with respect to the rotational direction U, outward away from the base 32 in the radial direction. After passing through a horizontal plane through the rotary axis 28, the printed product then slides into the relevant open clamp 42, which is at a standstill in the direction of the receiving part 30. The clamp is then closed and, during the following working stroke in the transporting direction T, carries along the printed product 10. The working stroke is carried out after the clamp is closed and is terminated before the second feeder 14, with respect to the transporting direction T, allows the relevant printed product 10 to drop into the receiving part 30. The clamp 42 is then opened and displaced by a return stroke counter to the transporting direction T. In this arrangement, the printed product 10 previously transported by the clamp 42 is retained by the guide plate 70 and the front wall 36 of the receiving part 30. After passing beneath the horizontal plane through the rotary axis 28, the second fed printed product 10 slides, on the guide plate 70, outward in the radial direction and into the second clamp 42, with respect to the transporting direction T. After being closed, the second clamp then grips the two printed products 10 and carries them along during the following working stroke. In this manner, the printed products 10 are transported and collated, in steps, in the transporting direction T, from one feeder 14 to the next and then to the remover 18.

It is, of course, also conceivable, in the embodiments shown in FIGS. 2 and 3, to drive the drawing member 46, and thus the clamps 42, in steps. A drive step preferably takes place after closure of the clamps and is terminated before printed products 10 are introduced into the receiving part 30 again. In this case, the clamps may remain closed until they pass beneath, for example, a horizontal plane through the rotary axis 28. This arrangement has the advantage that the guide plates 70 do not have to assume a retaining function for the printed products 10. Thus, the guide plates 70 may be designed in a simpler manner and with a smaller amount of pressure-exerting force, if any at all, in the direction of the front wall 36. In addition, carry-along members 74 would not be necessary.

It would also be conceivable to force those printed products 10 that have been introduced into the receiving parts 30 in a positive manner, for example by lifting guides, in the direction of the opening 34 and into the clamps 42. This permits different configurations of the rotary path, for example, those with a rectilinear, preferably horizontal, section in which the printed products can be introduced into the clamps.

In the embodiment shown in FIGS. 2 and 3, the movement paths of the clamps 42 run around the receiving parts 30. However, it is also conceivable for the return strand of the transporting device 40 to be arranged outside the section 48' in the radial direction.

In the embodiments shown in FIGS. 1–6, the receiving parts 30 move along a circular rotary path around the rotary axis 28. It is, however, also conceivable to design the circular rotary path in elongate form, i.e. in the manner of a circulating conveyor with rectilinear and curved sections.

The present invention has been illustrated and described with respect to the preferred embodiments of the invention. It is understood that the invention is not limited thereto, but may be otherwise variously embodied and practiced within the scope of the following claims including all equivalents.

I claim:

1. An apparatus for processing printed products comprising:

a plurality of pocket-like receiving parts driven in a rotary path, the receiving parts being arranged one behind the other and transversely with respect to the rotary path, the receiving parts also having a base and an opening opposite the base;

at least one feeder for introducing printed products into the receiving parts;

a plurality of controlled clamps assigned to each receiving part, the clamps moving in the rotary path with the receiving parts and transporting the printed products in the receiving parts, the clamps also having a movement path with at least a section of the movement path running along the opening of the respective receiving part, the clamps further including a mouth directed toward the interior of the receiving part when the clamps are in the section of the movement path running along the opening of the receiving part, the mouth retaining and transporting printed products that are arranged in the receiving part at a border region of the printed products remote from the base.

2. The apparatus of claim 1, wherein the clamps assigned to each receiving part are arranged one behind the other on an endless drawing member driven in rotation, the drawing member having an active strand running parallel to the opening.

3. The apparatus of claim 2, wherein the movement path runs around the receiving part.

4. The apparatus of claim 1, wherein the clamps assigned to each receiving part are moved back and forth together by a control device, the control device carrying out a transporting stroke of the clamps and a return stroke of the clamps, the clamps being closed before or during the transporting stroke and opened again before the return stroke.

5. The apparatus of claim 1, wherein the movement path runs at a distance from the opening and the clamps retain the printed products at a border region of the printed products projecting beyond the opening.

6. The apparatus of claim 1, wherein the receiving parts are arranged in a drum-like manner around a common horizontal rotary axis and have a radially inner base and an outer opening and printed products introduced into the receiving parts slide from the base in the direction of the clamps through a region of the rotary path of the receiving parts, the clamps being opened to receive the border region of the printed products sliding into the clamp mouth.

7. The apparatus of claim 6, wherein the clamps have a stop for the printed products in a base of the mouth.

8. The apparatus of claim 6, wherein at least two feeders are arranged to be offset in the direction of the rotary axis, each receiving part has opposing walls and a guide element between the opposing walls, a printed product supplied by a first feeder comes to lie, during transportation in the receiving part, on one side of the guide element, and a printed product supplied by a second feeder is introduced into the receiving part on the other side of the guide element.

* * * * *